US008888474B2

(12) United States Patent
Hohl et al.

(10) Patent No.: US 8,888,474 B2
(45) Date of Patent: Nov. 18, 2014

(54) DOWNHOLE MOTORS AND PUMPS WITH ASYMMETRIC LOBES

(75) Inventors: Carsten Hohl, Hannover (DE); Harald Grimmer, Niedersachsen (DE)

(73) Assignee: Baker Hughes Incorporated, Houston, TX (US)

( * ) Notice: Subject to any disclaimer, the term of this patent is extended or adjusted under 35 U.S.C. 154(b) by 448 days.

(21) Appl. No.: 13/227,954

(22) Filed: Sep. 8, 2011

(65) Prior Publication Data

US 2013/0064702 A1 Mar. 14, 2013

(51) Int. Cl.

| | |
|---|---|
| ***F01C 1/10*** | (2006.01) |
| ***F03C 2/00*** | (2006.01) |
| ***F03C 4/00*** | (2006.01) |
| ***F04C 2/00*** | (2006.01) |
| ***F03C 2/08*** | (2006.01) |
| ***F04C 2/107*** | (2006.01) |
| ***F04C 2/08*** | (2006.01) |
| ***F04C 13/00*** | (2006.01) |
| ***E21B 4/02*** | (2006.01) |

(52) U.S. Cl.

CPC ... *E21B 4/02* (2013.01); *F03C 2/08* (2013.01); *F04C 2/1071* (2013.01); *F04C 2/084* (2013.01); *F04C 13/008* (2013.01); *F04C 2/086* (2013.01)

USPC ..... 418/48; 418/1; 418/152; 418/153

(58) Field of Classification Search

USPC ..... 418/1, 48, 150, 152–153; 29/888.023

See application file for complete search history.

(56) References Cited

U.S. PATENT DOCUMENTS

| | | | | |
|---|---|---|---|---|
| 2,389,728 | A * | 11/1945 | Hill | 418/166 |
| 3,139,035 | A | 6/1964 | O'Connor | |
| 4,676,725 | A | 6/1987 | Eppink | |
| 4,863,359 | A | 9/1989 | Unterstrasser et al. | |
| 5,114,325 | A * | 5/1992 | Morita | 418/171 |
| 5,171,138 | A | 12/1992 | Forrest | |
| 5,318,416 | A | 6/1994 | Hantschk et al. | |
| 6,309,195 | B1 | 10/2001 | Bottos et al. | |
| 6,604,921 | B1 | 8/2003 | Plop et al. | |
| 6,604,922 | B1 | 8/2003 | Hache | |
| 6,716,008 | B1 * | 4/2004 | Kachele | 418/48 |

(Continued)

FOREIGN PATENT DOCUMENTS

| | | | |
|---|---|---|---|
| CA | 2504529 A1 | 11/2005 | |
| FR | 2616861 A1 * | 12/1988 | F16C 33/10 |

(Continued)

OTHER PUBLICATIONS

FR 2616861 A1, Killian, Jean Luc—Hydrodynamic Bearings with Lobes—Dec. 23, 1988.*

(Continued)

*Primary Examiner* — Theresa Trieu

(74) *Attorney, Agent, or Firm* — Cantor Colburn LLP

(57) ABSTRACT

In an aspect, the disclosure provides an apparatus for use downhole. In one aspect the apparatus includes a rotor with lobes disposed in stator with lobes, wherein at least one of the contours of the rotor lobe and the contour of the stator lobe is asymmetric.

18 Claims, 3 Drawing Sheets

(56) References Cited

U.S. PATENT DOCUMENTS

| | | | | |
|---|---|---|---|---|
| 6,905,319 | B2 * | 6/2005 | Guo | 418/48 |
| 6,944,935 | B2 | 9/2005 | Hache | |
| 7,083,401 | B2 | 8/2006 | Hooper | |
| 7,442,019 | B2 | 10/2008 | Kaiser et al. | |
| 7,517,202 | B2 | 4/2009 | Delpassand | |
| 7,739,792 | B2 | 6/2010 | Lee et al. | |
| 7,828,533 | B2 | 11/2010 | Podmore | |
| 2002/0074167 | A1 | 6/2002 | Plop | |
| 2003/0192184 | A1 | 10/2003 | Hache | |
| 2005/0089429 | A1 | 4/2005 | Delpassand et al. | |
| 2005/0089430 | A1 | 4/2005 | Hooper | |
| 2009/0016893 | A1 | 1/2009 | Lee et al. | |
| 2010/0086425 | A1 | 4/2010 | Steele | |
| 2011/0070111 | A1 | 3/2011 | Slay et al. | |

FOREIGN PATENT DOCUMENTS

| | | | | |
|---|---|---|---|---|
| GB | 2085969 | A * | 5/1982 | F04C 2/10 |
| WO | WO0144615 | A2 | 6/2001 | |
| WO | WO2005019652 | A1 | 3/2005 | |
| WO | WO2009127831 | A2 | 10/2009 | |

OTHER PUBLICATIONS

International Search Report and Written Opinion dated Feb. 18, 2013 for International Application No. PCT/US2012/049019.

International Search Report and Written Opinion dated Feb. 26, 2013 for International Application No. PCT/US2012/053759.

* cited by examiner

DOWNHOLE MOTORS AND PUMPS WITH ASYMMETRIC LOBES

BACKGROUND INFORMATION

1. Field of the Disclosure

This disclosure relates generally to drilling motors and progressive cavity pumps for use in wellbore operations.

2. Brief Description of the Related Art

To obtain hydrocarbons such as oil and gas, boreholes or wellbores are drilled by rotating a drill bit attached to a drill string end. A substantial proportion of current drilling activity involves drilling deviated and horizontal boreholes to increase the hydrocarbon production and/or to withdraw additional hydrocarbons from the earth's formations. Modern directional drilling systems generally employ a drill string having a drill bit at the bottom that is rotated by a positive displacement motor (commonly referred to as a "mud motor" or a "drilling motor"). A typical mud motor includes a power section that contains a stator and a rotor disposed in the stator. The stator typically includes a metal housing lined inside with a helically contoured or lobed elastomeric material. The rotor includes helically contoured lobes made from a metal, such as steel. Pressurized drilling fluid (commonly known as the "mud" or "drilling fluid") is pumped into a progressive cavity formed between the rotor and stator lobes. The force of the pressurized fluid pumped into the cavity causes the rotor to turn in a planetary-type motion. The elastomeric stator liner provides seal between the stator lobes and rotor lobes. The elastomeric liner also provides support for the rotor and thus remains under high load conditions during operation of the mud motor or the pump. Each lobe includes a load side and a sealing side. The load side is typically under much greater stress and strain compared to the sealing side. The currently available drilling motors employ symmetrical geometry for the rotor lobes and for the inner contour of the stator. Such symmetrical designs do not take into the effects of the load conditions on the stator and rotor lobes.

There is a trade-off between reduced stress and strain on the uniform liner and the preservation of the volumetric efficiency and power output of the drilling motor.

The disclosure herein provides drilling motors and progressive cavity pumps with asymmetric lobe geometries for rotor and/or stators that address some of the deficiencies of symmetrical lobe geometries.

SUMMARY

In one aspect, the disclosure provides an apparatus for use downhole. One embodiment of such apparatus includes a rotor with lobes disposed in a stator with lobes, wherein at least one of the contours of the rotor lobe or the stator lobe is asymmetric.

In another aspect, a method is disclosed that in one embodiment may include the features of: providing a stator having a stator lobe that includes a contour along an inner surface of the stator; and providing a rotor in the stator, the rotor including a rotor lobe having a contour on an outer surface of the rotor, wherein at least one of the contour of the rotor lobe and the contour of the stator lobe includes an asymmetric contour.

Examples of certain features of the apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

For detailed understanding of the present disclosure, references should be made to the following detailed description, taken in conjunction with the accompanying drawings in which like elements have generally been designated with like numerals and wherein.

DESCRIPTION OF THE EMBODIMENTS

Figure 1:
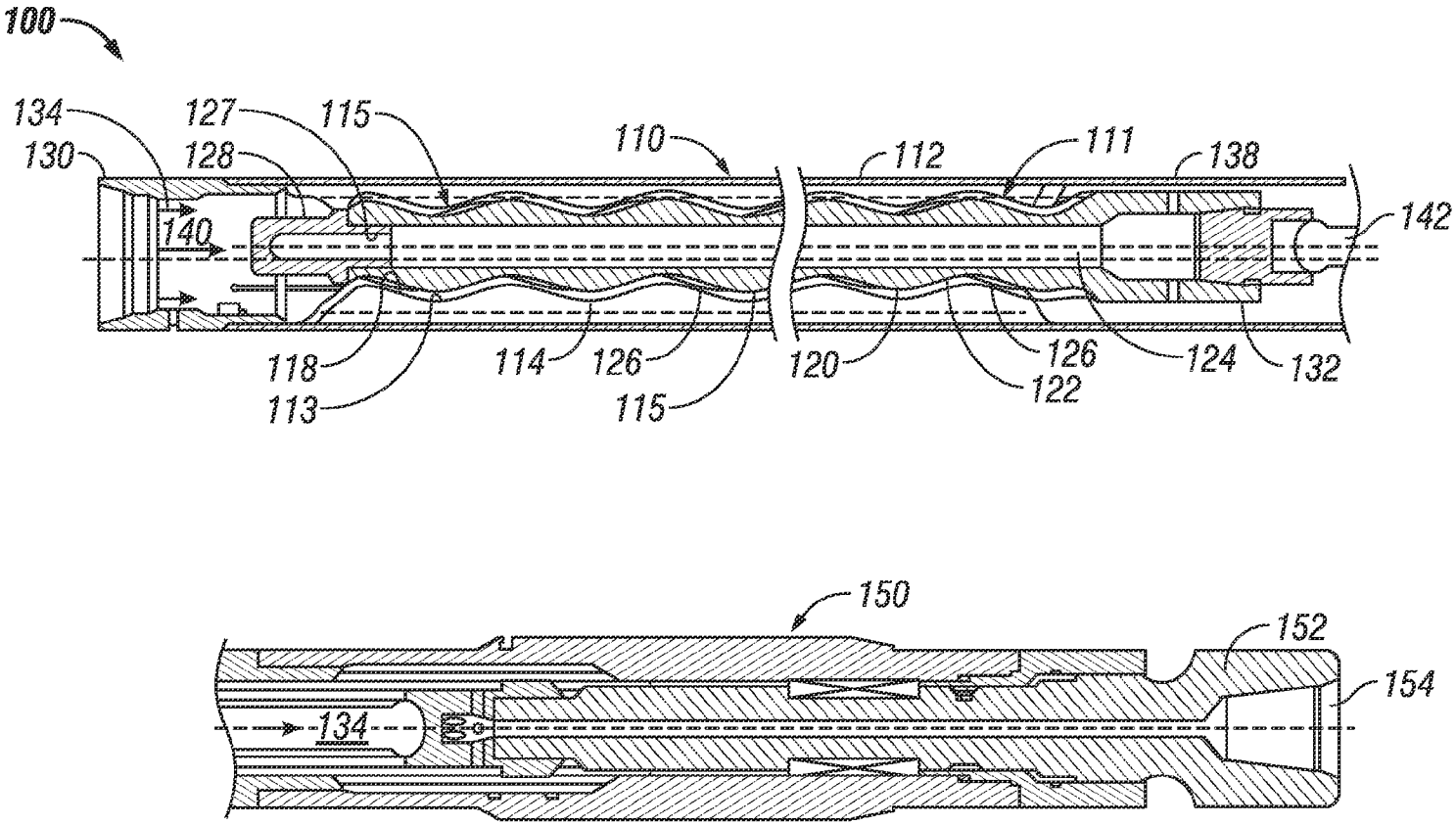
FIG. 1 is a longitudinal cross-section of a drilling motor that includes a stator and rotor made according to an embodiment of the disclosure.

FIG. 1 shows a cross-section of an exemplary drilling motor 100 made according to an embodiment of the disclosure herein. The drilling motor 100 includes a power section 110 and a bearing assembly 150. The power section 110 contains a stator 111 and a rotor 120 placed inside the stator 111. The stator 111 includes an elongated metal housing 112 having a number of lobes 115 with an inner metallic lobed contour or profile 113. The stator housing 112 may be preformed with the inner metallic contour 113. The inner contour 113 of the stator housing is lined with an elastomeric liner 114 that includes an inner lobed contour 118. The liner 114 is secured inside the housing 112 by a suitable process, such as molding, vulcanization, etc. The rotor 120 is typically made of a suitable metal or an alloy and includes lobes 122. The stator 111 includes one lobe more than the number of rotor lobes. The rotor 120 is rotatably disposed inside the stator 111. In aspects, the rotor 120 may include a bore 124 that terminates at a location 127 below the upper end 128 of the rotor 120 as shown in FIG. 1. The bore 124 remains in fluid communication with the drilling fluid 140 below the rotor 120 via a port 138.

Still referring to FIG. 1, the rotor lobes 122, stator lobes 115 and their helical angles are configured such that the rotor lobes 122 and the stator lobes 115 seal at discrete intervals, resulting in the creation of axial fluid chambers or cavities 126. The drilling fluid 140 supplied under pressure to the mud motor 100 flows through the cavities 126, as shown by arrow 134, causing the rotor 120 to rotate inside the stator 110 in a planetary fashion. The design and number of the stator lobes 115 and rotor lobes 122 define the output characteristics of the drilling motor 100. In one configuration, the rotor 120 is coupled to a flexible shaft 142 that connects to a rotatable drive shaft 152 in the bearing assembly 150. A drill bit (not shown) is connected to a bottom end of the bearing assembly 150 at a suitable bit box 154. During a drilling operation, the pressurized fluid 140 rotates the rotor 120 that in turn rotates the flexible shaft 142. The flexible shaft 142 rotates the drill shaft 152 that, in turn, rotates the bit box 154 and thus the drill bit. In other aspects, the stator housing may be made of any non-elastomeric material, including, but not limited to, a ceramic or ceramic-based material, reinforced carbon fibers, and a combination of a metallic and a non-metallic material. Also, the rotor may be made from any suitable material, including, but not limited to, ceramic, ceramic-based material, carbon fibers, a metal, a metal alloy and a combination of metallic and a non-metallic materials. Exemplary rotors and stators with asymmetrical lobe profiles are described in reference to FIGS. 2-5.

Figure 2:
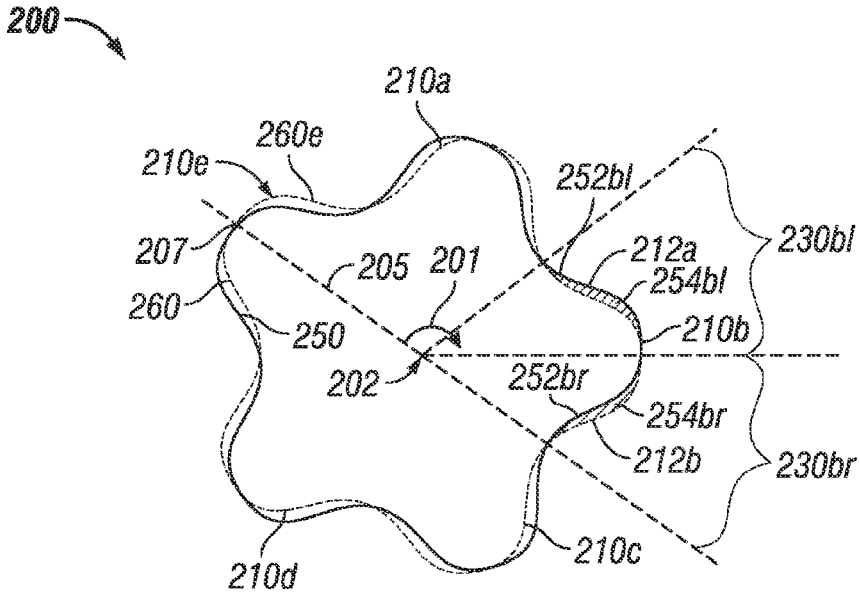
FIG. 2 is line diagram of a cross-section of a rotor with rotor lobes having asymmetric contours superposed over symmetric contours.

FIG. 2 is line diagram of a cross-section of a rotor 200 that includes rotor lobes with asymmetric contours 250. FIG. 2 also shows symmetric contours 260 relative to the asymmetric contours 250. In FIG. 2, the rotor 200 is shown to include lobes 210*a*-210*e*, each such rotor lobe having an asymmetric contour. For example, lobe 210*e* has an asymmetric contour 250*e*. A symmetric contour for lobe 210*e* is shown by contour 260*e*. The contour 260*e* is symmetric about an axis 205 that runs from the rotor center 202 through the center 207 of the lobe 210*e*. A symmetric contour typically is semicircular about the centerline 205. Typically, the rotor rotates in a clockwise direction, such as shown by arrow 201.

Still referring to FIG. 2, during rotor rotation, the left side of a rotor lobe (also referred to herein as the trailing side), such as lobe 210*b* comes into contact with the left side of a stator and the right side of the rotor lobe (also referred herein as the leading side) comes in contact with the right side of the stator. In FIG. 2, for example, the left side of the rotor lobe 210*b* is designated as 212*a* and the right side as 212*b*. The left side of each rotor lobe is subject to large loads whereas the right side of each rotor lobe is subject to relatively small loads. The right sides of the lobes provide seal between the progressive cavities or chambers. Since one side of a lobe is under greater load as compared to the other side, the contours of such sides may be adjusted independently to enhance motor performance. In one aspect, the disclosure herein provides asymmetric contours for the rotor lobes to improve the motor performance. Since the two sides of the rotor lobes fulfill different functions (load versus seal), both sides of the rotor lobes may be adjusted independently to provide asymmetric contours. The left side and the right side of a lobe may be built from different types of trochoids or derivatives of trochoids or have different parameters to same trochoids. This leads to unequal or different lobe geometries. However, in aspects, the layout of the envelope diameter and the eccentricity are kept the same so as not to have geometrical discontinuity in the transition between both the contours. In such designs, the mating flanks of rotor and stator are based on the same trochoid type and associated parameters. An advantage of asymmetric lobes is that the contours can be adjusted based on the primary function of the lobe side, i.e., the load or sealing functions. The independent adjustment of the lobe contours also may take into account various operating parameters, such as contact pressure, sliding velocities, sealing geometry, deformation, etc. Accounting for such and other parameters in the design of asymmetric lobe contours may improve performance of conventional (a tubular lined with an elastomer), pre-contoured stators (stators having equidistant liners) and metal-metal motors (metal rotor and metal stator). In the particular configuration of the rotor 200 shown in FIG. 2, the left side (trailing side) of each rotor lobe may be independently adjusted relative to a symmetric lobe. For example, the left side 252*bl* of lobe 210*b* is adjusted by the area 254*bl* while the right side (leading side) 252*br* is adjusted by the area 254*br*, that provides different contours for the left side and the right side. Thus, in one aspect, the slope of one side of the rotor lobe may differ from the slope of the other side of the rotor lobe relative to the center line, such as line 205. The amount of the adjustment may be based on design criteria that may include parameters: anticipated maximum load on the side, contact pressure, sliding velocities, sealing geometry, deformation, wellbore environment, such as pressure and temperature, etc. The asymmetric contour may be determined using any known method, such as finite element analysis, predetermined test data, etc.

Figure 3:
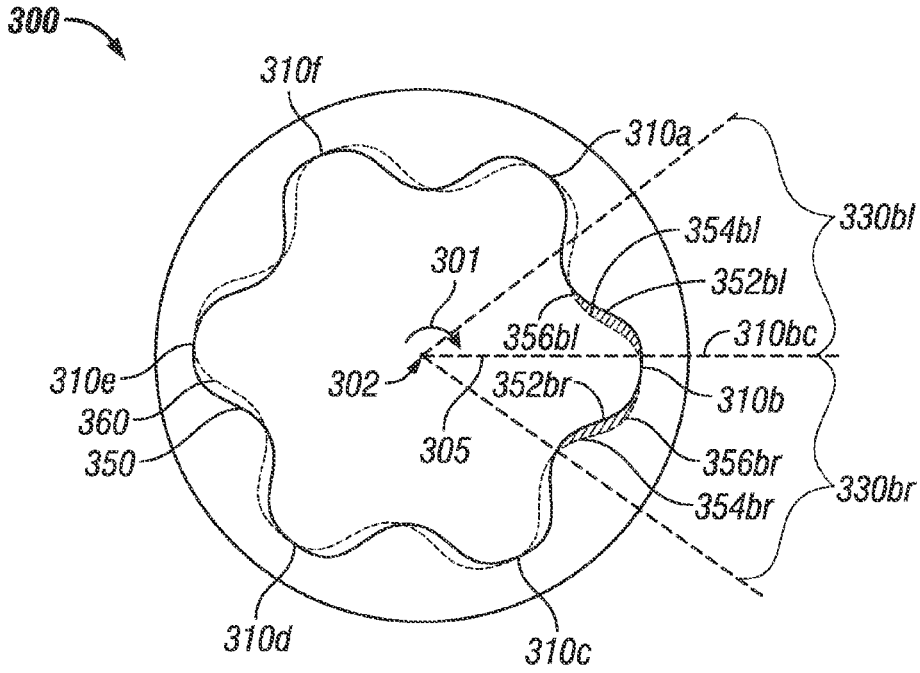
FIG. 3 is a line diagram of a cross-section of a stator with stator lobes having asymmetric contours superposed over symmetric contours.

FIG. 3 is a line diagram of a cross-section of a stator 300 that includes stator lobes with asymmetric contour 350. FIG. 3 also shows a symmetric contour 360 relative to the asymmetric contour 350. The stator 300 is shown to include lobes 310*a*-310*f* (one lobe more than the number of rotor lobes). During operation, the stator 300 remains stationary while the rotor (FIG. 2) rotates inside the stator 300. The rotational direction of the rotor is shown as clockwise by arrow 301. During rotation of the rotor, the left side of a stator lobe, such as side comes into contact with the left side of a stator lobe and vice versa. Therefore, the left sides of the stator lobes are subject to large loads whereas the right sides of the stator lobes are subject to relatively small loads. The right side of the stator lobe, however, provides seal between the progressive cavities or chambers. Since one side of a stator lobe is under heavier load when compared to the other side, the configurations of such side may be adjusted to enhance motor performance. In one aspect, the disclosure herein provides asymmetric contours for the stator lobes to improve the motor performance. Since the two sides of the stator lobes fulfill different functions (load versus seal), both sides of the lobes may be adjusted independently to provide asymmetric contours. The two sides of the stator lobes may have different contours. For example, the left side 330*bl* of the stator lobe 310*b* has a contour 352*bl* while the right side 330*br* of the stator lobe 310*bl* has the contour 352*br*. The contours 352*bl* and 352*br* are asymmetric with respect the centerline 305 passing from the stator center 302 through the center 310*bc* of the stator lobe 310*b*. The difference in area between the asymmetric contour 352*b* and the symmetric contour 354*bl* is shown by crossed area 356*bl* while the difference in area on the right side is shown by crossed area 356*br*. In the particular configuration of stator 300, the stator lobe contours match the rotor lobe contours of rotor 200 shown in FIG. 2. For other rotor and stator combinations, the asymmetric contours may be different, based on the various design criteria utilized, such as describe in reference to FIG. 2.

Figure 4:
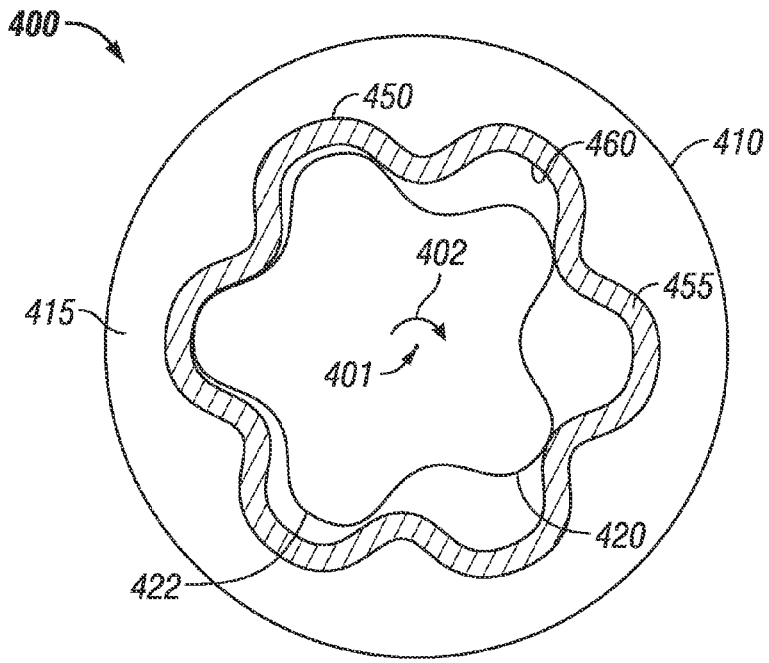
FIG. 4 is a line diagram of a cross-section of a power section of a progressive cavity device with a stator lined with an elastomeric liner including asymmetric lobe contour and a rotor disposed in the stator, the rotor also including rotor lobes with asymmetric contours.

FIG. 4 is a line diagram of a cross-section of a power section of a progressive cavity downhole device 400, such as a motor or pump. The device 400 includes a rotor 420 disposed in a stator 410. The rotor 420 includes lobes with an outer asymmetric contour 422 made according to the methods described in reference to FIG. 2. The rotor 420 is shown to rotate in a clockwise manner 402. The stator 410 includes a housing 415 with a pre-formed symmetric or asymmetric lobed contour 450. In the particular configuration of stator 415 shown in FIG. 4, the contour 450 is lined with a liner 455 having an internal asymmetric contour 460 made according to the methods described in reference to FIGS. 2 and 3. In another configuration, the stator housing 415 may have a pre-formed asymmetric internal lobed contour that is lined with a liner having same thickness so as to form stator lobes with asymmetric contours. The liner thickness may also be non-equidistant.

Figure 5:
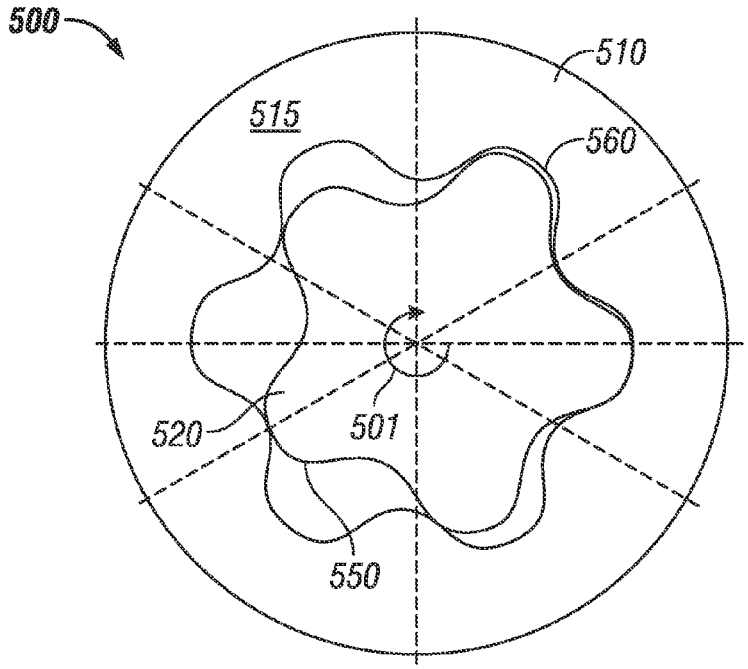
FIG. 5 is a line diagram of a cross-section of a power section of a progressive cavity device with a metallic stator that includes asymmetric lobe contours and a stator disposed in the stator with the stator including asymmetric rotor lobes.

FIG. 5 is a line diagram of a cross-section of a power section of a progressive cavity device 500, such as a motor or pump. The device 500 includes a rotor 520 disposed in a stator

510. The rotor 520 includes lobes with an outer asymmetric contour 550 made according to an embodiment of this disclosure. The stator 510 includes a housing 515 with a pre-formed asymmetric lobed contour 560 made according to an embodiment of this disclosure. In one aspect, both the stator 510 and the rotor 520 are made of a non-elastomeric material, such as steel. In such a case the device 500 is referred to as metal-metal progressive cavity device (for example metal-metal motor or metal-metal pump). The disclosure herein provides exemplary configurations of progressive cavity device. The disclosure, however, applies to other device that include lobes with asymmetric contours.

The foregoing description is directed to particular embodiments for the purpose of illustration and explanation. It will be apparent, however, to persons skilled in the art that many modifications and changes to the embodiments set forth above may be made without departing from the scope and spirit of the concepts and embodiments disclosed herein. It is intended that the following claims be interpreted to embrace all such modifications and changes.

The invention claimed is:

1. An apparatus for use downhole, comprising:

a stator including a stator lobe having a contour along an inner surface of the stator; and a rotor in the stator, the rotor including a rotor lobe having a contour on an outer surface of the rotor, wherein the contour of the rotor lobe is asymmetric and the rotor lobe includes a first side and a second side and wherein geometry of the first side is configured to provide a loading surface and the geometry of the second side is configured to provide a sealing surface.

2. The apparatus of claim 1, wherein a stator lobe includes a first side and a second side and wherein geometry of the first side differs from the geometry of the second side.

3. The apparatus of claim 1, wherein the stator includes an asymmetric pre-contour.

4. The apparatus of claim 1, wherein the stator lobe includes a first side and a second side and wherein slope of the first side relative to a centerline passing through center of the stator differs from slope of the second side relative to the centerline.

5. The apparatus of claim 1, wherein the rotor lobe includes a first side and a second side and wherein a slope of the first side relative to an axis of the rotor is greater than a slope of the second side relative to the axis.

6. The apparatus of claim 1, wherein contour of the rotor lobe is compliant with the contour of the stator lobe.

7. The apparatus of claim 1, wherein one of the rotor contour and the stator contour is based on one of a trochoid and a derivative of a trochoid.

8. The apparatus of claim 1, wherein the rotor lobe is made from a metallic material and the stator lobe is made from one of a metallic material and an elastomeric material.

9. A method of providing an apparatus, comprising:

providing a stator having a stator lobe that includes a contour along an inner surface of the stator; and providing a rotor in the stator, the rotor including a rotor lobe having a contour on an outer surface of the rotor;

wherein, the contour of the rotor lobe includes an asymmetric contour and the rotor lobe includes a first side and a second side and wherein geometry of the first side is configured to provide a loading surface and the geometry of the second side is configured to provide a sealing surface.

10. The method of claim 9, wherein the stator lobe includes a first side and a second side and wherein geometry of the first side differs from the geometry of the second side.

11. The method of claim 9, wherein the stator includes an asymmetric pre-contour.

12. The method of claim 9, wherein the stator lobe includes a first side and a second side and wherein slope of the first side relative to an axis of the stator differs from a slope of the second side relative to the axis.

13. The method of claim 9, wherein the rotor lobe includes a first side and a second side and wherein the first side is configured to withstand greater load than the load on the second side.

14. The method of claim 9, wherein the rotor lobe includes a first side and a second side and wherein slope of the first side relative to an axis of the rotor differs from slope of the second side relative to the axis.

15. The method of claim 9, wherein contour of the rotor lobe is compliant with the contour of the stator lobe.

16. A drilling assembly, comprising:

a drilling motor having a stator that includes a stator lobe having a contour along an inner surface of the stator; and a rotor in the stator, the rotor including a rotor lobe having a contour on an outer surface of the rotor, wherein the contour of the rotor lobe is asymmetric and the rotor lobe includes a first side and a second side and wherein geometry of the first side is configured to provide a loading surface and the geometry of the second side is configured to provide a sealing surface.

17. The drilling assembly of claim 16, the stator lobe includes a first side and a second side and wherein geometry of the first side differs from geometry of the second side.

18. The drilling assembly of claim 16, wherein the contours of the rotor lobe corresponds to a trochoid or a trochoid derivative.

* * * * *